US005325803A

United States Patent [19]

Jans et al.

[11] Patent Number: 5,325,803

[45] Date of Patent: Jul. 5, 1994

[54] ICEBREAKING SHIP

[75] Inventors: Peter Jans, Emden; Karl-Heinz Rupp; Jens-Holger Hellmann, both of Hamburg, all of Fed. Rep. of Germany

[73] Assignee: Thyssen Nordseewerke GmbH, Emden, Fed. Rep. of Germany

[21] Appl. No.: 66,611

[22] Filed: May 10, 1993

Related U.S. Application Data

[63] Continuation-in-part of Ser. No. 820,423, Jan. 14, 1992, Pat. No. 5,231,944.

[30] Foreign Application Priority Data

May 9, 1992 [DE] Fed. Rep. of Germany ..... 4215334

[51] Int. Cl.[5] ..... B63B 35/08

[52] U.S. Cl. ..... 114/40; 114/56

[58] Field of Search ..... 114/56, 40–42

[56] References Cited

U.S. PATENT DOCUMENTS

| | | | |
|---|---|---|---|
| 3,985,091 | 10/1976 | Waas | 114/40 |
| 4,326,476 | 4/1982 | Pole | 114/40 |
| 4,506,617 | 3/1985 | Waas et al. | 114/41 |
| 4,781,135 | 11/1988 | Lindquist | 114/40 |
| 4,831,951 | 5/1989 | Liljeström et al. | 114/41 |
| 5,038,695 | 8/1991 | Varges | 114/40 |

FOREIGN PATENT DOCUMENTS

| | | |
|---|---|---|
| 0281653 | 9/1988 | European Pat. Off. . |
| 0328720 | 8/1989 | European Pat. Off. . |
| 2106776 | 9/1971 | Fed. Rep. of Germany . |
| 2112333 | 9/1972 | Fed. Rep. of Germany . |
| 2246173 | 3/1973 | Fed. Rep. of Germany . |
| 2212146 | 9/1973 | Fed. Rep. of Germany . |
| 2212147 | 9/1973 | Fed. Rep. of Germany . |
| 2241840 | 3/1974 | Fed. Rep. of Germany . |
| 2343719 | 3/1975 | Fed. Rep. of Germany . |
| 2429703 | 1/1980 | France . |

*Primary Examiner*—Jesus D. Sotelo

*Attorney, Agent, or Firm*—Nils H. Ljungman & Associates

[57] ABSTRACT

For icebraking ships whose forward quarter is designed like a pontoon with an underside rising obliquely forward, and having icebreaking configurations on its sides, the hull can be equipped on both sides over the entire length of the ship with balcony-like flanks that improve the maneuverability of the icebreaking ship. The undersides of the balcony-like flanks can drop off obliquely downward and preferably lie at the level of the water line so that, during the turning of the ship, the oblique undersides can break off the edges of the ice. Further, the underside of the bow in the vicinity of the icebreaking configurations can be designed wider that the water line of the afterbody, to thus provide a clearance between the edges of the ice and the hull.

17 Claims, 3 Drawing Sheets

ICEBREAKING SHIP

Cross Reference to Related Application

This application claims continuation-in-part status from U.S. application Ser. No. 07/820,423, filed on Jan. 14, 1992, now U.S. Pat. No. 5,231,944 which claims priority from Federal Republic of Germany Patent Application No. P 41 01 034, filed on Jan. 16, 1991.

BACKGROUND OF THE INVENTION

1. Field of the Invention

The invention concerns an icebreaking ship having a forward quarter designed like a pontoon with the underside of the bow extending from the ship bottom roughly to the beginning of the front third of the bow and rising obliquely forward to above the water line. The lateral edges of the bow in the vicinity of the water line bear icebreaking or cutting means and the width of the icebreaking or cutting means in the vicinity of the water line is greater than the width of the water line of the afterbody of the hull. The hull can also have balcony-like flanks on both sides, with a parapet that is preferably oriented roughly vertically. The balcony undersides adjoining the parapet can be oriented obliquely downward and the balcony support adjoining oblique surfaces, until the transition to the essentially flat ship bottom, can be oriented roughly vertically. The water line of the hull runs roughly parallel, and preferably somewhat outward to the half width of the underside of the balcony.

2. Background Information

Icebreakers of this type, which were disclosed in German Patent 4101034, have recessed waistline-like indentations in the body of the ship on both sides adjoining the pontoon-like forward quarter.

Furthermore, in this known icebreaker, the balcony-like flanks adjoining the indentations extend all the way to the stern.

It is true that, with appropriate dimensions of depth and length, the waistline-like indentations essentially provide a small turning circle radius during turns of the ship and, consequently, good maneuverability. However, such indentations tend to require significant construction interventions in the structure of the ship's hull and, consequently, increased cost.

Moreover, the indentations tend to disrupt the flow of water currents along the ship's side, which circumstance usually has a disadvantageous effect on resistance, particularly during forward travel in ice-free waters.

OBJECT OF THE INVENTION

The object of the invention is to overcome these deficiencies and accordingly to improve the design of an icebreaker such that the icebreaker requires essentially no complex structural forms of the ship's hull, and furthermore has essentially no flow-restricting elements.

SUMMARY OF THE INVENTION

This object is achieved by the present invention in an icebreaking ship having balcony-like flanks which extend the entire length, or virtually the entire length of the hull of the ship. These flanks preferably do not have any indentations therein directed toward the interior of the ship, and the flanks preferably run essentially parallel to the longitudinal axis of the ship. The ship preferably has balcony supports, or side wall portions of the hull, below the balcony-like flanks, while the hull portion preferably has at the deck level, or top thereof, a parapet extending along each side of the ship above the balcony.

Preferably, the width of the underside of the bow at its starting point, or the bottom of the ship, corresponds roughly to the distance from the balcony support on one side of the ship to the balcony support on the other side of the ship. From that starting point forward, the bow preferably widens continuously until reaching the width of the underside of the bow in the vicinity of the water line. In the bow portion of the hull, the distance from the parapet on one side of the ship to the parapet on the other side is preferably greater than the width of the underside of the bow in the vicinity of the water line.

The above-discussed features of the present invention, in addition to the advantages mentioned, achieve several additional astonishing effects, in that the icebreaking or cutting means disposed on the lateral edges of the bow can improve course stability during travel in a broken ice channel and can also improve the ease of turning in curved travel because of their outwardly angled position relative to the longitudinal axis of the ship.

Known icebreaker ships have been able to actively break the ice with at least one of the bow or stern portions. To achieve turning capability, these icebreakers have been built with a lenticular water line, i.e., without a parallel center section, or with only a very short parallel center section.

Because of this lenticular water line, and the resultant irregularly broken edge of the ice, and partially also because of additional improvements in the design of lateral projections on the bow and possibly even on the stern, such known icebreaking ships can travel in circles using forces on their rudder.

The present invention is based on the idea that icebreaking means are present not only on the bow and stern, but essentially extend along preferably the entire length of the icebreaker on the ship's sides. This icebreaker according to the present invention is thus essentially completely surrounded by icebreaking means, i.e., at preferably every point of its water line.

Using the transverse forces generated by the control elements or rudders, the icebreaker of the present invention is preferably capable of breaking ice in the forward quarter area on the inside of the curves, and both midships, and in the stern area on the outside of the curves, as well. This capability is a function of the transverse forces of the control elements, and of the slope of the underside of the balcony and of the ice conditions, such as thickness and solidity.

Known icebreakers usually have a bulkhead angle of incidence of 0 degrees to a maximum of approximately 25 degrees from vertical. With sufficiently thick ice, this bulkhead angle of incidence is usually too small to break ice via the sides of the ship during curved travel using the transverse forces of the control elements. The above-mentioned small angles of incidence should essentially only serve to reduce the forces exerted by the ice when the ice presses against the ship.

Several variant embodiments of the present invention are summarized herebelow.

The underside of the bow for the icebreaker of the present invention can be designed so that the underside of the bow above and below the water line perpendicular to the longitudinal axis of the ship is flat, slightly bowed, or flexed to thereby be particularly advantageous for breaking a straight ice channel. Further, the underside of the bow can preferably be designed so that between its starting point on the ship bottom to above the water line, each side is preferably flexed upward at an angle such that longitudinal lateral faces are produced. Such a design essentially enables centering of the ship more readily in its ice channel.

Further, the lateral edges of the underside of the bow can preferably be beveled and/or rounded, so that slide-off of the ice clods from the icebreaking means either into the channel between the bottom of the balcony and the balcony support, or under the underside of the bow should be facilitated.

Also, a bottom clearing wedge can be disposed on the ship bottom, preferably below the water line, and preferably in the vicinity of the starting point of the underside of the bow to divert ice clods which have made their way under the bottom of the bow to the sides of the ship. This design protects the drive and control elements astern against contact with ice to increase their level of efficiency and/or to protect them from damage.

Also, by designing the forward quarter of the hull, to continuously widen toward the base, the distance from the parapet to the parapet must be greater than the width of the underside of the bow in the vicinity of the water line, since with this measure the distance from the underside of the balcony to the underside of the balcony is also increased in this area.

The icebreaking ship according to the present invention can also be equipped with a device for generating and sustaining a swaying motion of the ship essentially around its central longitudinal axis. As such, the turning behavior of the ship can be indirectly improved since, as a result of the swaying motions, the breakup of the edge of the ice is intensified by the oblique underside of the balcony, particularly during turning.

BRIEF DESCRIPTION OF THE DRAWINGS

The object of the invention as well as several variants are illustrated in detail in the accompanying drawings. The drawings depict, in each case, a perspective view, with a plurality of profile curves distributed over the length of the ship illustrated. In the drawings.

DESCRIPTION OF THE PREFERRED EMBODIMENTS

Figure 1:
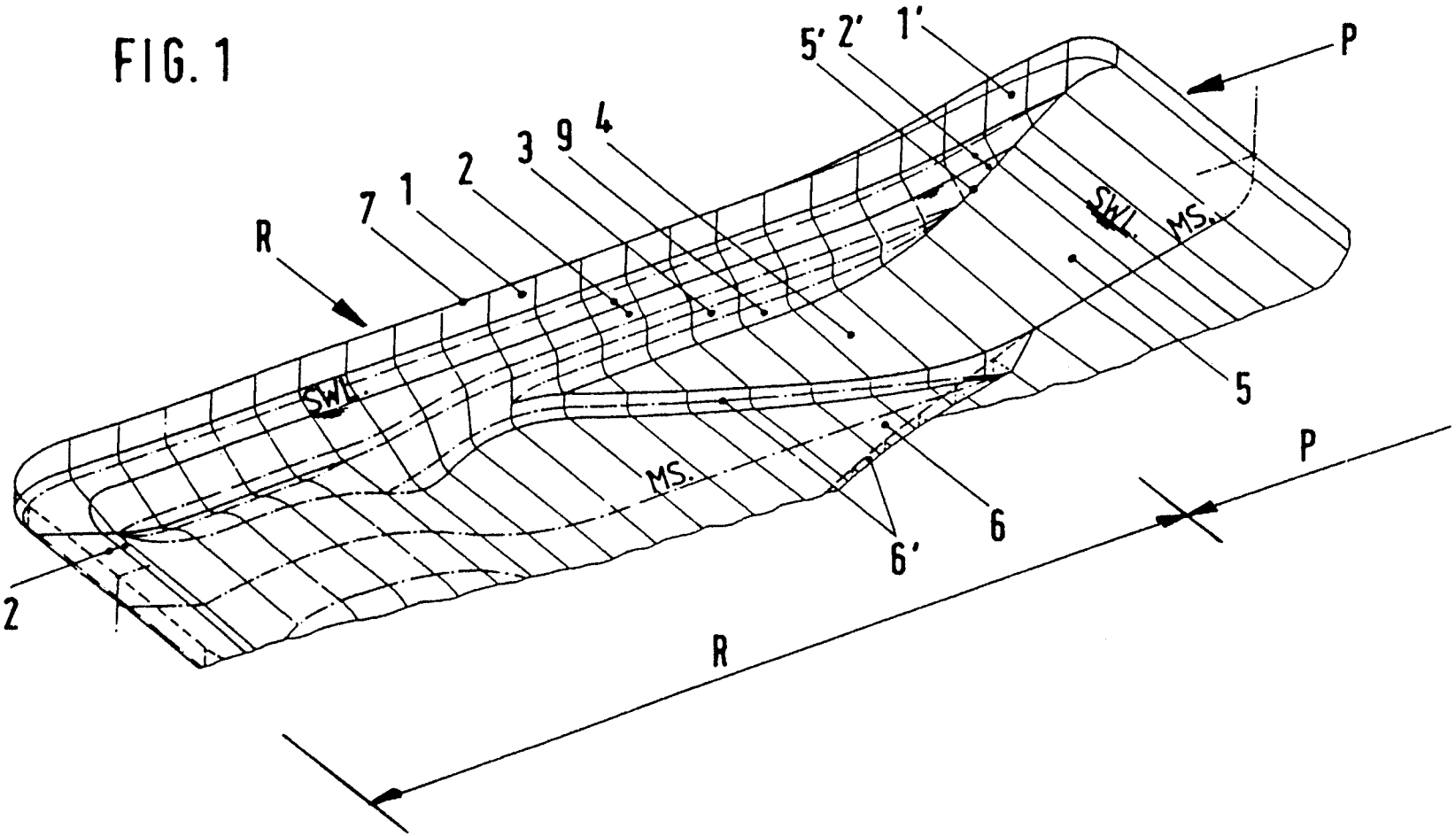
FIG. 1 shows a ship's hull designed according to the present invention with the underside of the bow continuously flat in the transverse direction and with largely straight flanks.

In all figures, the same parts of the icebreaker are provided with the same reference symbols.

The letter R generally refers to the icebreaker's hull, the starboard side of which is depicted in all of the figures with a plurality of profile curves distributed over along the length of the ship. Based on these profile lines it can be seen that the flanks of the ship are shaped like a balcony. In essence, the balconies extend along substantially the entire length of the ship, and even along the stern area. Further, with the exception of a slight widening of the forward quarter toward the bow, the balconies run generally parallel to the longitudinal axis of the ship.

It can also be seen that the parapets 1, 1' are roughly vertical and the adjoining balcony undersides 2, 2' are preferably oriented obliquely downward at an angle of approximately 30 degrees. The adjoining balcony supports 3, which also represent the flank of the stern and which essentially make a transition to the flat bottom of the ship, are likewise essentially vertical.

The forward quarter, referenced as a whole by the letter P, is preferably designed like a pontoon, or in other words, the underside 5 of the forward quarter P is preferably roughly perpendicular to the longitudinal center plane of the ship, and essentially extends on both sides of this plane. Further, the underside along this forward quarter P preferably rises obliquely from the bottom of the ship 4 to the bow.

The area where the underside 5 of the bow starts out from the bottom 4 of the ship is preferably located roughly in the front third of the length of the ship, and the transition from the bottom 4 of the ship to the underside 5 of the bow can preferably be a continuous or smooth transition.

In this transition area, the underside 5 of the bow can preferably have the width of the balcony support 3, and the lateral edges 5' of the underside 5 can thus make a transition into the curve 9 located between the balcony supports 3 and the bottom 4 of the ship. The underside 5 of the bow also preferably gradually widens towards the front, until it finally essentially matches the width of the hull at the parapet 1'.

In the area where the underside 5 of the bow intersects the water line, hereinafter abbreviated SWL, the lateral edges 5' are preferably designed as icebreaking means, which, together with the underside 5 of the bow, break a channel with essentially straight linear ice edges in a sheet of ice. The continuous widening of the underside 5 of the bow is preferably selected such that the distance between the lateral edges 5' in the vicinity of the SWL is slightly larger than the width in the SWL for the rest of the hull R. disposed therebehind.

Figure 2:
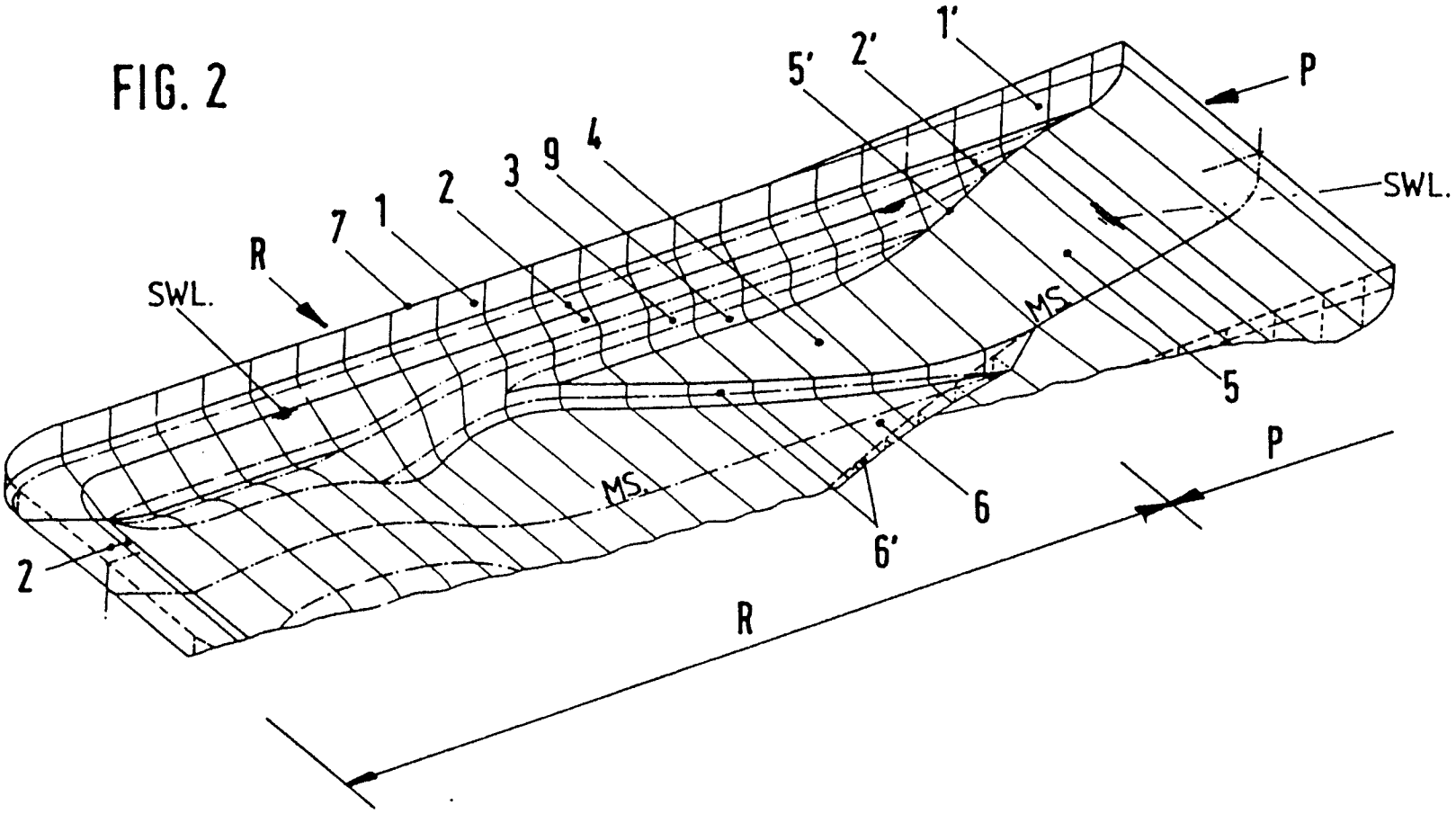
FIG. 2 shows a ship's hull designed according to the present invention with the underside of the bow flat in the transverse direction and the lateral edges bowed outwards.

In the variant according to FIG. 1, the lateral edges 5' of the underside 5 of the bow in the vicinity of the SWL essentially form a straight line extending from the bottom 4 to the parapet 1'. In the variant according to FIG. 2, the lateral edges 5' essentially represent outwardly bowed curves.

In both variants, the underside 5 of the bow in the vicinity of the SWL, and at right angles to the longitudinal axis of the ship, is essentially flat, and in the area thereunder, is slightly flexed downwardly. This downward flexion essentially can provide a good transition to a bottom clearing wedge 6 which begins in the vicinity of this downward flexion and expands in a V-shape aft. The branched extensions 6' of the clearing wedge 6 essentially provide a transition into the balcony supports 3.

Figure 3:
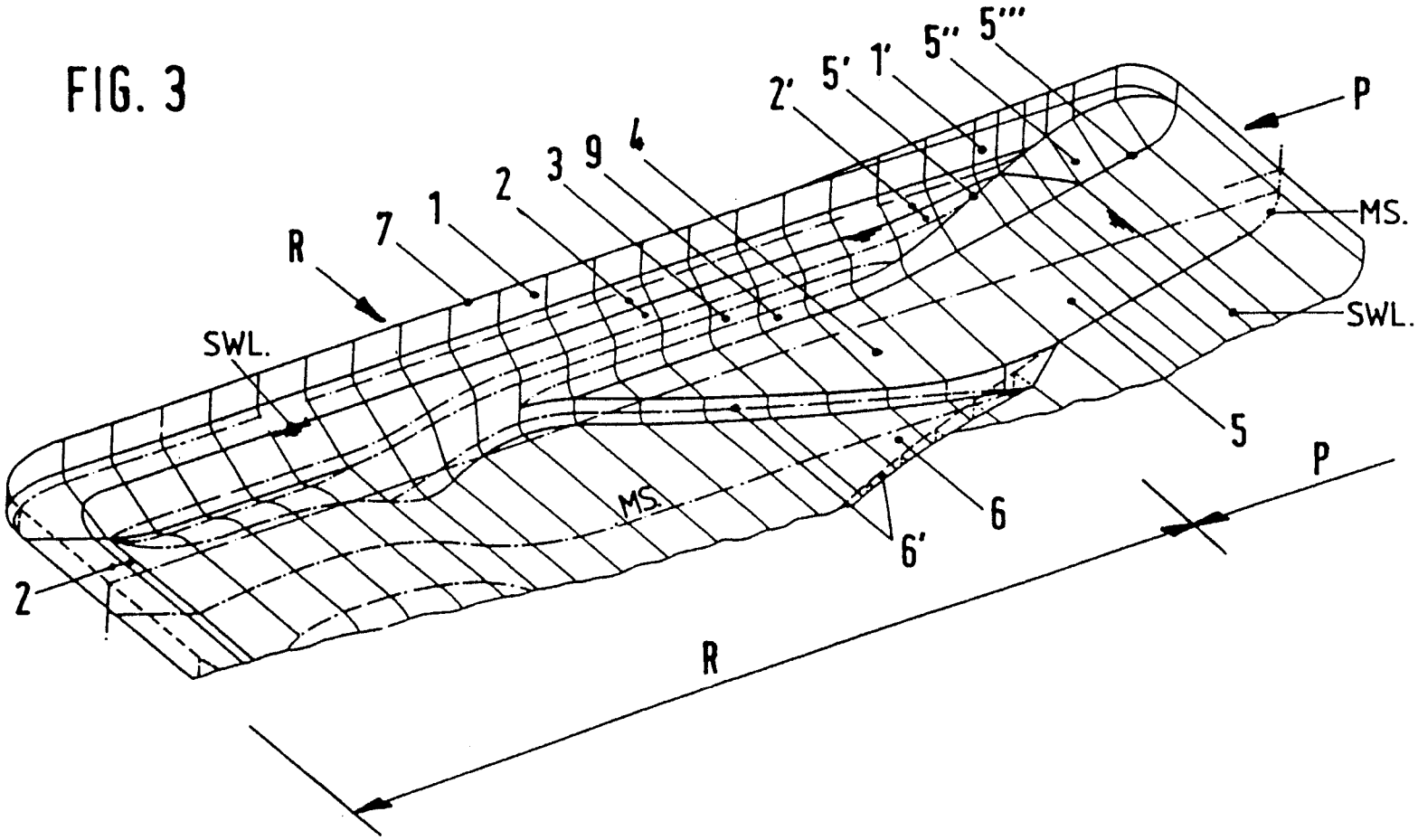
FIG. 3 shows a ship's hull designed according to the present invention with lateral faces bent upward in the transverse direction along the lateral edges of the underside of the bow.

In the variant according to FIG. 3, this design is somewhat altered in that the underside 5 of the bow is provided on each side over its entire length with lateral faces 5'' angled upwardly relative to their center surface. The lateral faces 5'' are delimited by the edges 5''' and the lateral edge 5', both of which edges 5''' and 5' provide a transition to the bottom 4 in the curve 9.

As already mentioned, in all variants the distance between the parapets 1' preferably increases slightly in the area of the forward quarter P and, consequently, the width of the upper deck 7 can also increase in a similar manner, roughly from the beginning of the forward quarter P, continuously toward the bow.

This increase in width thereby allows the distance between the undersides 2' of the balconies in this area to be increased accordingly.

It is thus common to all variants that the channel which the underside of the bow breaks in the ice is somewhat wider than the width of the SWL of the afterbody R such that a clearance remains between the afterbody R and the edges of the ice of the channel. This clearance can thereby prevent a possible jamming-in of the hull R.

Another variant, not shown, but significant within the framework of the invention, provides the icebreaking ship of the present invention with an arrangement for generating a swaying motion of the ship essentially around its central longitudinal axis. Such arrangements are generally known in the art. By providing such a swaying motion, additional breaking forces can be transmitted from the undersides 2, 2' of the balconies to the edges of the ice. The ice can thereby be broken by the balconies and the clearance between the edges of the ice and the hull R can be widened. This widening increases the turning capability of the ship in the ice.

One feature of the invention resides broadly in an icebreaking ship whose forward quarter P is designed like a pontoon with the underside of the bow extending from the ship bottom roughly at the beginning of the front third thereof rising obliquely forward to above the water line, whose lateral edges in the vicinity of the water line bear icebreaking or cutting means (reamers) and whose width in the vicinity of the water line is greater than the width of the water line of the afterbody, whereby the hull has balcony-like flanks on both sides, whose parapet is oriented roughly vertically, the balcony underside adjoining it is oriented obliquely downward and the balcony support adjoining it until the transition to the essentially flat ship bottom is oriented roughly vertically, and whereby the water line runs roughly parallel, preferably somewhat outward, to the half width of the underside of the balcony, characterized in that the balcony-like flanks extend the entire length or virtually the entire length of the hull R and have no indentations directed toward the interior of the ship and run essentially parallel to the longitudinal axis of the ship, that furthermore the width of the underside 5 of the bow at its starting point on the ship bottom 4 corresponds roughly to the distance from the balcony support 3 to the balcony support 3 and from there forward widens continuously until it reaches the width of the underside 5 of the bow in the vicinity of the water line SWL, and that the distance from the parapet 1' to the parapet 1' and thus the width of the upper deck 7 is greater than the width of the underside 5 of the bow in the vicinity of the water line SWL.

Another feature of the invention resides broadly in the ship, characterized in that the increase in the width of the underside 5 of the bow is selected such that its lateral edges 5' each yield a straight or slightly curved line.

Yet another feature of the invention resides broadly in the ship, characterized in that the underside 5 of the bow above and below the water line (SWL), perpendicular to the longitudinal axis of the ship is flat, slightly bowed, or flexed.

Still another feature of the invention resides broadly in the ship, characterized in that the underside 5 of the bow between its starting point on the ship bottom 4 to above the water line SWL is on each side flexed upward at an angle such that longitudinal lateral faces 5'' are produced (FIG. 3).

Still yet another feature of the invention resides broadly in the ship, characterized in that the lateral edges 5' of the underside 5 of the bow are beveled and/or rounded.

Yet still another feature of the invention resides broadly in the ship, characterized in that a bottom clearing wedge 6 is disposed on the ship bottom 4, which wedge is attached below the water line SWL, preferably in the vicinity of the starting point of the underside 5 of the bow, and its branched extensions 6' make a gradual transition to the balcony support 3 or blend into the bottom of the ship.

Another feature of the invention resides broadly in the ship, characterized in that the distance from the parapet 1' to the parapet 1' and, consequently, also the distance from the balcony underside 2' to the balcony underside 2' in the vicinity of the pontoon-like forward quarter P of the bow is designed continuously widening toward the bow.

Still another feature of the invention resides broadly in the ship, characterized in that it is equipped with a known arrangement, which is preferably equipped with hydraulically, mechanically, or pneumatically controllable means, which, as needed, generates and sustains a swaying motion of the ship essentially around its central longitudinal axis.

Examples of arrangements for generating a swaying motion, which may be utilized in accordance with the embodiments of the present invention, may be found in the following U.S. patents: U.S. Pat. No. 4,777,899, which issued to Bettcher on Oct. 18, 1988; U.S. Pat. No. 4,070,981, which issued to Guinn et al. on Jan. 31, 1978, and U.S. Pat. No. 3,921,823, which issued to Bourree et al. on Nov. 25, 1975.

All, or substantially all, of the components and methods of the various embodiments may be used with at least one embodiment or all of the embodiments, if any, described herein.

All of the patents, patent applications and publications recited herein, if any, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The appended drawings, in their entirety, including all dimensions, proportions and/or shapes in at least one embodiment of the invention, are, if applicable, accurate and to scale and are hereby incorporated by reference into this specification.

The invention as described hereinabove in the context of the preferred embodiments is not to be taken as limited to all of the provided details thereof, since modifications and variations thereof may be made without departing from the spirit and scope of the invention.

What is claimed is:

1. A ship for breaking ice to clear a channel through an ice field, the ship having a hull, said hull having a bow, a stern, a length extending from said bow to said stern, first and second sides extending from said bow to said stern, and a width between said first and second sides, said hull comprising:

icebreaking means, said icebreaking means extending across a width of said bow and along a substantial portion of the length of said hull along each of said first and second sides thereof;

said hull is for being disposed in water to a depth defined by a water line, and said icebreaking means being disposed at least in the vicinity of the water line;

said first and second sides of said hull have a first wall portion disposed below the water line, a second wall portion disposed above the water line, and a connecting portion connecting said first wall portion to said second wall portion;

said connecting portion being disposed substantially along said water line of said ship;

said hull having a first width at said first wall portions, and a second width at said second wall portions, said first width being less than said second width;

said connecting portion comprising said icebreaking means along each of said first and second sides;

each of said first wall portions and said second wall portions are disposed substantially vertically; and said connecting portion is disposed obliquely downward between said first wall portion and said second wall portion at an angle of about 30°.

2. The ship according to claim 1, wherein:

the ship has a bottom;

the bow comprises a forward ⅓ portion of the ship, the bow has a bottom;

the bottom of the bow of the ship rises from the bottom of the ship to a position above the water line in a forward direction of the ship;

the hull has a front-most edge;

the hull comprises a third width at the water line along the front-most edge, the third width at the water line being the greatest hull width at the water line; and the bow bottom in the vicinity of the water line at the front-most edge comprises lateral edges, said lateral edges being configured for cutting ice.

3. The ship according to claim 2, wherein:

the ship bottom is substantially flat;

the bow bottom intersects the ship bottom at a transitional area wherein a transition from the bow bottom to the ship bottom is substantially smooth; and the ship has a fourth width in said transitional area, said fourth width being substantially the same as said first width.

4. The ship according to claim 3, wherein:

the ship has a central longitudinal axis;

said second wall portions are disposed substantially parallel to the central longitudinal axis of the ship;

the ship has a deck portion disposed above the water line in the bow portion of the ship, the deck portion at the front-most edge of the ship having a fifth width, said fifth width being greater than said third width; and said water line along said connecting portion is substantially parallel to said longitudinal axis of the ship.

5. The ship according to claim 4, wherein:

said lateral edges of the bow bottom are one of:

substantially linear from said transitional area to said front-most end of the ship; and curved outwardly away from the ship from said transitional area to said front-most end of the ship; and the bottom of the bow, in a direction perpendicular to the central longitudinal axis is one of:

flat, bowed, and flexed.

6. The ship according to claim 5, wherein:

said lateral edges are one of: rounded and bevelled;

said bottom of the ship comprises an ice clearing wedge;

said wedge having a point disposed in the vicinity of said transitional area along the central longitudinal axis;

said wedge widening towards said first and second sides in a direction towards the stern of the ship to push ice out from under the ship; and said wedge towards the stern of the ship being contiguous with one of:

said first side portions of the ship, and said bottom of the ship.

7. The ship according to claim 6, wherein:

said bow portion, above said water line, continuously widens towards the front-most edge of the ship;

said ice-breaking means extend along substantially the entire length of the hull;

said ship comprises means for rocking the ship in a side-to-side motion about the central longitudinal axis;

said ice breaking means further extend across the stern of the ship at said water line of the ship; and the hull of the ship, along the first and second sides thereof, is configured without indentations projecting towards the central longitudinal axis.

8. The ship according to claim 1, wherein:

the ship has a bottom;

the bow has a bottom;

the bottom of the bow of the ship rises in a forward direction of the ship from the bottom of the ship to a position above the water line;

the bow comprises a third width adjacent the bottom of the hull, and a fourth width at the position above the water line, the fourth width being greater than the third width;

the hull has a front end;

the hull comprises a fifth width at the water line along the front end, the fifth width at the water line being the greatest hull width at the water line; and the bow bottom in the vicinity of the water line at the front end comprises lateral edges, said lateral edges being configured for cutting ice.

9. The ship according to claim 8, wherein:

the ship bottom is substantially flat;

the bow bottom intersects the ship bottom at a transitional area wherein a transition from the bow bottom to the ship bottom is substantially smooth;

the ship has a sixth width in said transitional area, said sixth width being substantially the same as said first width.

the ship has a central longitudinal axis;

said second wall portions are disposed substantially parallel to the central longitudinal axis of the ship;

said water line along said connecting portions is substantially parallel to said central longitudinal axis of the ship;

said lateral edges of the bow bottom are one of:

substantially linear from said transitional area to said point above the water line; and curved outwardly away from the ship from said transitional area to said point above the water line; and the bottom of the bow, in a direction perpendicular to the central longitudinal axis is one of:

flat, bowed, and flexed;

said lateral edges are one of: rounded and bevelled;

said bottom of the ship comprises an ice clearing wedge;

said wedge having a point disposed in the vicinity of said transitional area along the central longitudinal axis;

said wedge widening towards said first and second sides in a direction towards the stern of the ship to push ice out from under the ship;

said wedge towards the stern of the ship being contiguous with one of:

said first side portions of the ship, and said bottom of the ship;

said bow portion, above said water line, continuously widens towards the front end of the ship;

said ice-breaking means extend along the entire length of the hull;

said ship comprises means for rocking the ship in a side to side motion about the central longitudinal axis;

said ice breaking means further extend across the stern of the ship at said water line of the ship; and the hull of the ship, along the first and second sides thereof, is configured without indentations projecting towards the central longitudinal axis.

10. An icebreaking ship having a bottom, a hull, a forward quarter designed like a pontoon, a bow, an afterbody disposed sternward behind the bow, and a longitudinal axis, the hull comprising:

a first side and a second side disposed in a spaced apart relation with respect to one another and extending along the afterbody;

the bow having an underside extending from the ship bottom at roughly the beginning of a front third of the ship and rising obliquely forward to above the water line;

the bow having lateral edges in the vicinity of the water line, said lateral edges comprising icebreaking means;

both the afterbody and the bow having a width in the vicinity of the water line, the width of the bow in the vicinity of the water line being greater than the width of the afterbody in the vicinity of the water line;

first side wall portions disposed below the water line and projecting flanks disposed above the water line on both of the first and second sides of the hull;

said projecting flanks on both of the first and second sides comprising a parapet portion oriented roughly vertically, and said first side wall portions being oriented roughly vertically;

said projecting flanks comprising an underside portion adjoining the parapet portion, the underside portion being oriented obliquely downward towards the first side wall portions;

the underside portions having a width extending from the first side wall portions to the parapet portion, and the ship water line runs roughly parallel, preferably somewhat outward, to a half-width of the underside portions of the projecting flanks;

said projecting flanks extend along at least a substantial portion of the length of the hull, have no indentations directed toward the interior of the ship, and run essentially parallel to the longitudinal axis of the ship;

the underside of the bow having a first width at its starting point on the bottom of the ship, and the hull having a second width extending from the first side wall portion on the first side of the hull to the first side wall portion on the second side of the hull;

the first width corresponding roughly to the second width, and from the starting point of the bow on the bottom of the ship, forward, the underside of the bow widens continuously to reach the width of the underside of the bow in the vicinity of the water line; and the hull has a third width extending from the parapet on the first side of the hull to the parapet on the second side of the hull, said third width being substantially a width of an upper deck of the ship, and said third width being greater than the width of the underside of the bow in the vicinity of the water line.

11. The ship according to claim 10, wherein the increase in the width of the underside of the bow is configured such that the lateral edges of the bow each yield one of:

a straight line; and a slightly curved line.

12. The ship according to claim 10, wherein the underside of the bow above and below the water line, in a direction perpendicular to the longitudinal axis of the ship, is one of:

flat;

slightly bowed; and flexed.

13. The ship according to claim 12, wherein the underside of the bow, between its starting point on the bottom of the ship to above the water line is, on each side of the ship, flexed upward at an angle such that longitudinal lateral faces are produced.

14. The ship according to claim 13, wherein the lateral edges of the underside of the bow are at least one of:

beveled; and rounded.

15. The ship according to claim 14, wherein the ship comprises a bottom-clearing wedge disposed on the bottom of the ship, the wedge being attached below the water line, preferably in the vicinity of the starting point of the underside of the bow, and the wedge comprises diverging lateral surfaces diverging towards the afterbody of the ship, said lateral surfaces gradually joining with one of:

the balcony supports; and the bottom of the ship.

16. The ship according to claim 15, wherein, along the pontoon-like forward quarter of the bow, both the third width from the parapet on the first side of the ship to the parapet on the second side of the ship, and also a width from the balcony underside on the first side of the ship to the balcony underside on the second side of the ship, continuously widen in a direction toward the bow.

17. The ship according to claim 16, further comprising means for generating and sustaining a swaying motion of the ship substantially about the central longitudinal axis of the ship, said swaying means comprising one of:

hydraulically controllable means for generating and sustaining a swaying motion;

mechanically controllable means for generating and sustaining a swaying motion; and pneumatically controllable means for generating and sustaining a swaying motion.

* * * * *